US009167665B2

(12) United States Patent
Takikita et al.

(10) Patent No.: US 9,167,665 B2
(45) Date of Patent: Oct. 20, 2015

(54) LIGHTING DEVICE, LIGHTING APPARATUS USING THE SAME, AND LIGHTING SYSTEM

(71) Applicant: Panasonic Corporation, Osaka (JP)

(72) Inventors: Hisaya Takikita, Osaka (JP); Masafumi Yamamoto, Hyogo (JP); Katsunobu Hamamoto, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 226 days.

(21) Appl. No.: 13/944,124

(22) Filed: Jul. 17, 2013

(65) Prior Publication Data

US 2014/0028196 A1 Jan. 30, 2014

(30) Foreign Application Priority Data

Jul. 24, 2012 (JP) ..... 2012-163845

(51) Int. Cl.

| | |
|---|---|
| ***H01J 1/60*** | (2006.01) |
| ***H01J 7/42*** | (2006.01) |
| ***H05B 37/04*** | (2006.01) |
| ***H05B 37/02*** | (2006.01) |
| ***H05B 33/08*** | (2006.01) |

(52) U.S. Cl.

CPC ..... *H05B 37/02* (2013.01); *H05B 33/089* (2013.01); *H05B 33/0851* (2013.01)

(58) Field of Classification Search

USPC ..... 315/119–136

See application file for complete search history.

(56) References Cited

U.S. PATENT DOCUMENTS

| | | | | |
|---|---|---|---|---|
| 5,706,185 | A * | 1/1998 | Toyama et al. | 315/127 |
| 6,528,957 | B1 * | 3/2003 | Luchaco | 315/307 |
| 2006/0220573 | A1 * | 10/2006 | Kotani et al. | 315/111.21 |
| 2010/0264846 | A1 * | 10/2010 | Chemel et al. | 315/294 |
| 2010/0269383 | A1 * | 10/2010 | Nifenecker | 40/541 |
| 2011/0037410 | A1 * | 2/2011 | Hsu et al. | 315/294 |
| 2011/0193481 | A1 * | 8/2011 | Nakamura | 315/82 |
| 2012/0119650 | A1 * | 5/2012 | Lee | 315/122 |
| 2012/0217873 | A1 * | 8/2012 | Tanaka | 315/82 |

FOREIGN PATENT DOCUMENTS

| | | |
|---|---|---|
| EP | 2434844 A2 | 3/2012 |
| EP | 2434844 A3 | 8/2012 |
| JP | 2012-074156 | 4/2012 |

* cited by examiner

*Primary Examiner* — Brandon S Cole

(74) *Attorney, Agent, or Firm* — Renner, Otto, Boisselle & Sklar, LLP

(57) ABSTRACT

A control unit controls an operation of an electric power conversion unit so that load current that flows through a light source load becomes a constant value, using electric power setting value that is used to determine a size of electric power that is supplied to the light source load and a current detection value that is detected by a current detection resistor (current detection unit), and a load electric power calculation unit obtains load electric power of the light source load using the electric power setting value and a voltage detection value that is detected by a voltage detection unit, and an input electric power estimation unit corrects a circuit loss for the obtained load electric power and estimates input electric power.

7 Claims, 4 Drawing Sheets

FIG. 3 A

| DIMMING RATE | | 100% | | | 60% | | | 25% | | |
|---|---|---|---|---|---|---|---|---|---|---|
| POWER SOURCE VOLTAGE | | 100V | 200V | 242V | 100V | 200V | 242V | 100V | 200V | 242V |
| MEASURED VALUE | INPUT ELECTRIC POWER (W) | 36.44 | 35.46 | 35.36 | 19.56 | 19.26 | 19.31 | 8.64 | 8.71 | 8.89 |
| CALCULATION RESULT | INPUT ELECTRIC POWER (W) | 35.87 | 35.87 | 35.87 | 19.67 | 19.54 | 19.61 | 8.80 | 8.74 | 8.80 |
| ERROR | | -1.570% | 1.151% | 1.437% | 0.553% | 1.440% | 1.529% | 1.861% | 0.331% | -0.970% |

FIG. 3 B

| DIMMING RATE | | 100% | | 60% | | 25% | |
|---|---|---|---|---|---|---|---|
| POWER SOURCE VOLTAGE | | 200V | | | | | |
| ERROR FACTOR | | 0°C | 50°C | 0°C | 50°C | 0°C | 50°C |
| MEASURED VALUE | INPUT ELECTRIC POWER (W) | 36.40 | 35.08 | 19.47 | 18.76 | 8.62 | 8.39 |
| CALCULATION RESULT | INPUT ELECTRIC POWER (W) | 36.06 | 35.20 | 19.74 | 19.07 | 8.81 | 8.67 |
| ERROR | | -0.926% | 0.337% | 1.398% | 1.671% | 2.120% | 3.322% |

FIG. 3 C

| DIMMING RATE | | 100% | | 60% | | 25% | |
|---|---|---|---|---|---|---|---|
| POWER SOURCE VOLTAGE | | 200V | | | | | |
| ERROR FACTOR | | Vfmin | Vfmax | Vfmin | Vfmax | Vfmin | Vfmax |
| MEASURED VALUE | INPUT ELECTRIC POWER (W) | 33.18 | 39.73 | 17.06 | 21.10 | 7.56 | 9.23 |
| CALCULATION RESULT | INPUT ELECTRIC POWER (W) | 33.20 | 39.87 | 17.27 | 21.54 | 7.68 | 9.54 |
| ERROR | | 0.081% | 0.344% | 1.261% | 2.079% | 1.563% | 3.431% |

LIGHTING DEVICE, LIGHTING APPARATUS USING THE SAME, AND LIGHTING SYSTEM

BACKGROUND OF THE INVENTION

1. Field of the Invention

The present invention is related to a lighting device that estimates input electric power, a lighting apparatus using the lighting device, and a lighting system.

2. Description of the Related Art

Conventionally, a power source apparatus has been proposed that measures input electric power (power consumption) and presents the measurement result to the outside while converting electric power that is supplied from an external power source as appropriate and supplying the electric power to a load. The measurement result of the input electric power that is obtained from such a power source apparatus is presented to a user of the power source apparatus, an administrator of a facility in which the power source apparatus is installed, etc., so that it is possible to help reduction (saving) of wasted power consumption, etc.

In a light source load using a light emitting diode (LED), which has attracted attention in recent years, the impedance is changed depending on the ambient temperature due to the temperature characteristic. In view of this point, a lighting device is known that tries to obtain input electric power sufficiently accurately even when the ambient temperature of the light source load varies, and for example, is disclosed in Japanese patent laid-open publication No. 2012-074156.

The lighting device that is disclosed in the above-described related art includes an electric power conversion unit configured to adjust electric power that is supplied to a light source load by an ON/OFF operation of a switching element and a control unit configured to input an electric power setting value that is used to determine the size of the electric power that is supplied to the light source load and control an operation of the electric power conversion unit. In addition, the lighting device includes a current detection unit configured to detect current that flows through the switching element and an electric power estimation unit configured to estimate input electric power using the value that is detected by the current detection unit. The electric power estimation unit corrects a portion of variation in a current detection value, which is generated due to change in the ambient temperature of the light source load, using the electric power setting value and the current detection value that corresponds to an output of the current detection unit, and obtains the input electric power.

In particular, in the electric power estimation unit, the electric power setting value is normalized using the electric power setting value when electric power that is supplied to the light source load becomes maximum, as a maximum electric power value, and the input electric power is obtained using an electric power adjustment value that corresponds to a difference between the electric power setting value and the current detection value.

In the conventional example that is disclosed in the above-described related art, it is necessary that the maximum electric power value of the light source load be stored in advance in order to obtain the input electric power. Therefore, for a certain light source load the maximum electric power value of which is stored, the input electric power can be obtained sufficiently accurately, and on the other hand, for another light source load having a different characteristic, there has been a problem in that the input electric power cannot be obtained sufficiently accurately due to variation in characteristics of light source loads.

SUMMARY OF THE INVENTION

It is an object of the present invention to provide a lighting device that can obtain input electric power sufficiently accurately even when there is variation in characteristics of light source loads and there is change in an ambient temperature of the light source load, a lighting apparatus using the lighting device, and a lighting system.

The lighting device according to the present invention includes an electric power conversion unit including a switching element, configured to adjust load electric power that is supplied to a light source load using DC electric power as an input, by ON/OFF of the switching element, a current detection unit configured to detect load current that flows through the light source load, a voltage detection unit configured to detect load voltage that is applied to the light source load, a control unit configured to control an operation of the electric power conversion unit so that the load current that flows through the light source load becomes a constant value, using an electric power setting value that is used to determine the size of electric power that is supplied to the light source load and the current detection value that is detected by the current detection unit, a load electric power calculation unit configured to obtain load electric power of the light source load using the electric power setting value and a voltage detection value that is detected by the voltage detection unit, an input electric power estimation unit configured to correct a circuit loss for the obtained load electric power and estimate input electric power, and a notification unit configured to notify the outside of the calculation result that is obtained in the input electric power estimation unit.

In such a lighting device, it is desirable that the input electric power estimation unit estimates the input electric power using the corrected circuit loss as a constant value regardless of input voltage and a lighting state of the light source load.

In such a lighting device, it is desirable that the input electric power estimation unit changes the circuit loss that is corrected using the electric power setting value, based on the lighting state of the light source load and estimates the input electric power.

In such a lighting device, it is desirable that the notification unit transmits a notification signal that includes the calculation result of the input electric power estimation unit as a digital signal.

In such a lighting device, it is desirable that the notification unit transmits a notification signal that includes the calculation result of the input electric power estimation unit as an analog signal.

The lighting apparatus according to the present invention includes any one of the above-described lighting devices and a fixture body that holds the lighting device and the light source load.

The lighting system according to the present invention includes a plurality of lighting apparatuses, each of which is the lighting apparatus, and a reading-out apparatus configured to receive the notification signal that is transmitted from the notification unit of the lighting apparatus and read out the calculation result of the input electric power estimation unit.

In the present invention, the control unit controls the load current that flows through the light source load to become the constant value, so that the voltage detection value of the load voltage of the light source load varies depending on the ambient temperature. In addition, in the present invention, the load electric power is calculated on the basis of the voltage detection value that is proportional to the load voltage of the light source load and the electric power setting value that is proportional to the load current of the light source load. That is, in the present invention, the load electric power and the input electric power can be obtained while both of variation in the ambient temperature of the light source load and variation in the characteristics of light source loads are considered. Thus, in the present invention, there is an effect that the input electric power can be obtained sufficiently accurately even when there is variation in characteristics of the light source loads and variation in the ambient temperatures of the light source load.

BRIEF DESCRIPTION OF THE DRAWINGS

The preferable embodiments of the present invention are described further in detail. Other features and advantages of the present invention can be better understood with reference to the following detailed description and the accompanying drawings.

FIG. 3A is a diagram illustrating a correlation between a measured value and a calculation result of input electric power when power source voltage is changed in the lighting device according to the embodiment of the present invention, FIG. 3B is a diagram illustrating a correlation between a measured value and a calculation result of input electric power when an ambient temperature is changed in the lighting device according to the embodiment of the present invention, FIG. 3C is a diagram illustrating a correlation between a measured value and a calculation result of input electric power when variation in load voltage of a light source unit occurs in the lighting device according to the embodiment of the present invention.

DETAILED DESCRIPTION OF EXEMPLARY EMBODIMENTS

Figure 1:
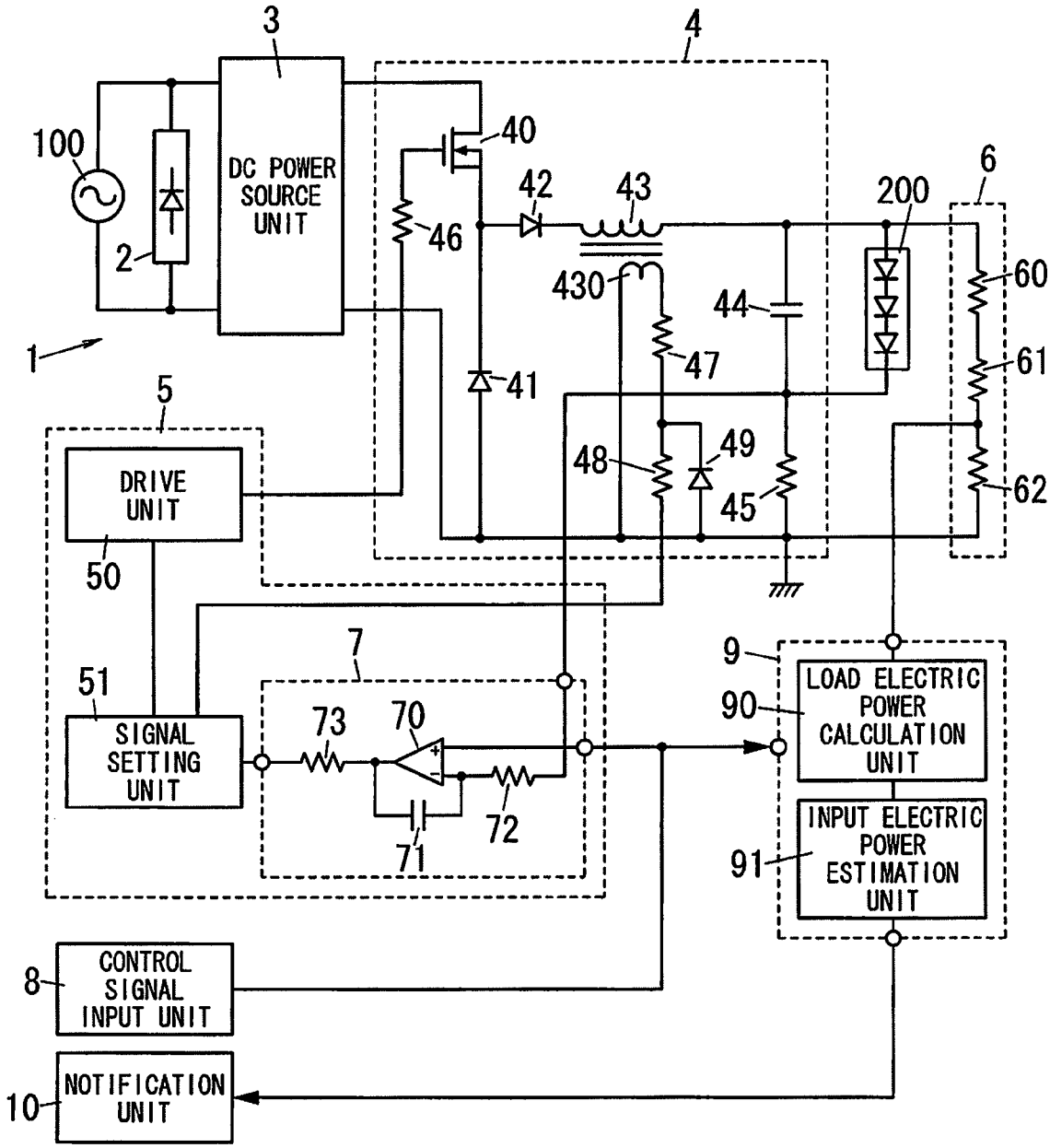
FIG. 1 is a circuit schematic diagram illustrating a lighting device according to an embodiment of the present invention.

A lighting device 1 according to an embodiment of the present invention is described below with reference to the drawings. As illustrated in FIG. 1, the lighting device 1 according to the embodiment includes a rectifier 2 that is connected to an AC power source 100, a DC power source unit 3, an electric power conversion unit 4, a control unit 5, a voltage detection unit 6, an electric power adjustment unit 7, a control signal input unit 8, an electric power calculation unit 9, and a notification unit 10.

The rectifier 2 that is constituted, for example, by a diode bridge, performs full-wave rectification on AC voltage that is output from the AC power source 100, and outputs the AC voltage. The DC power source unit 3 including a smoothing capacitor (not illustrated) smooths pulsating voltage that is output from the rectifier 2 and outputs DC voltage. The DC voltage is applied to the electric power conversion unit 4. It is noted that it is sufficient that the DC power source unit 3 includes at least a smoothing capacitor, and is not limited to a certain specific configuration.

The electric power conversion unit 4 is constituted by a step-down chopper circuit that includes: a series circuit of a switching element 40 that is constituted by a metal oxide semiconductor field effect transistor (MOSFET) and a diode 41; and a series circuit of a diode 42 and a choke coil 43 and a smoothing capacitor 44, which is connected to the diode 41 in parallel. The switching element 40 switches ON/OFF by applying a drive signal that is output from a drive unit 50 of the control unit 5, which is described later, through a resistor 46. In addition, a light source load 200 that is obtained by connecting a plurality of light emitting diodes (LED) in series is connected to the smoothing capacitor 44 in parallel. Thus, the electric power conversion unit 4 steps down the DC voltage that is output from the DC power source unit 3, applies the DC voltage to the light source load 200, and supplies DC electric power to the light source load 200.

A current detection resistor 45 (current detection unit) that is used to detect load current that flows through the light source load 200 is connected to the smoothing capacitor 44 in series. In addition, the voltage detection unit 6 that is used to detect load voltage that is applied to the light source load 200 is connected, in parallel, to the series circuit of the smoothing capacitor 44 and the current detection resistor 45. The voltage detection unit 6 is obtained by connecting three voltage detection resistors 60 to 62 in series. The voltage detection unit 6 divides the load voltage into voltage between both ends of the resistor 62 and outputs the voltage to a load electric power calculation unit 90 of the electric power calculation unit 9 that is described later.

The control unit 5 includes the drive unit 50 that applies a drive signal to the switching element 40 and a signal setting unit 51 that sets the drive signal on the basis of an electric power adjustment value that is described later. In addition, the control unit 5 includes the electric power adjustment unit 7 that is used to control load electric power of the light source load 200 to become a constant value.

Inductive voltage that is induced by a secondary winding 430 of the choke coil 43 is input to the signal setting unit 51 through resistors 47 and 48. It is noted that an overvoltage protection diode 49 is connected to the resistor 48 in parallel. In addition, output voltage of an operational amplifier 70 of the electric power adjustment unit 7, which is described later, is input to the signal setting unit 51 through a resistor 73. Hereinafter, a value of the output voltage of the operational amplifier 70 is referred to as "electric power adjustment value".

Figure 2A:
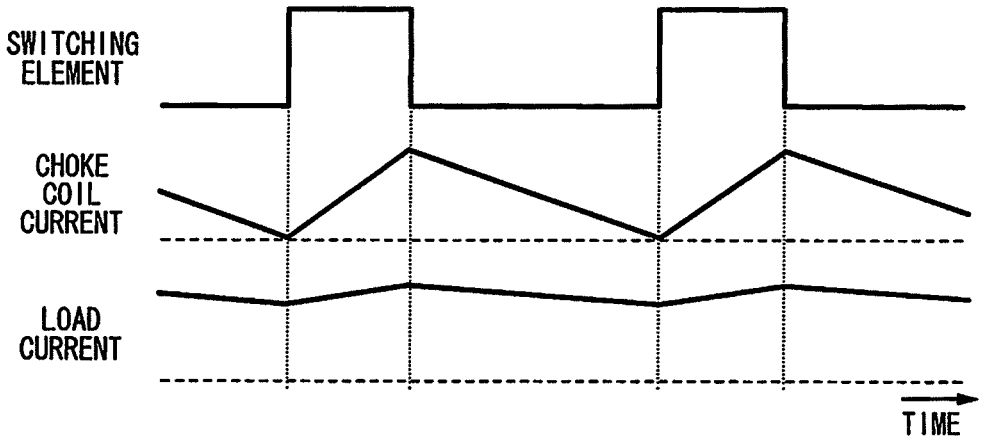
FIG. 2A is a time chart diagram illustrating current critical mode control of an electric power conversion unit in the lighting device according to the embodiment of the present invention.

When the inductive voltage that is input to the signal setting unit 51 becomes zero (that is, when current that flows through the choke coil 43 becomes zero), the control unit 5 switches the switching element 40 to ON through the drive unit 50. In addition, the control unit 5 switches the switching element 40 to OFF through the drive unit 50 when the value of the inductive voltage that is input to the signal setting unit 51 reaches the electric power adjustment value that is output from the electric power adjustment unit 7. That is, as illustrated in FIG. 2A, the control unit 5 applies a drive signal to the switching element 40 so that the controls are performed in a current critical mode. As a result, the electric power conversion unit 4 supplies constant DC current to the light source load 200. The control unit 5 adjusts the load current that flows through the light source load 200 by changing a frequency of the drive signal on the basis of the electric power adjustment value in the signal setting unit 51.

Figure 2B:
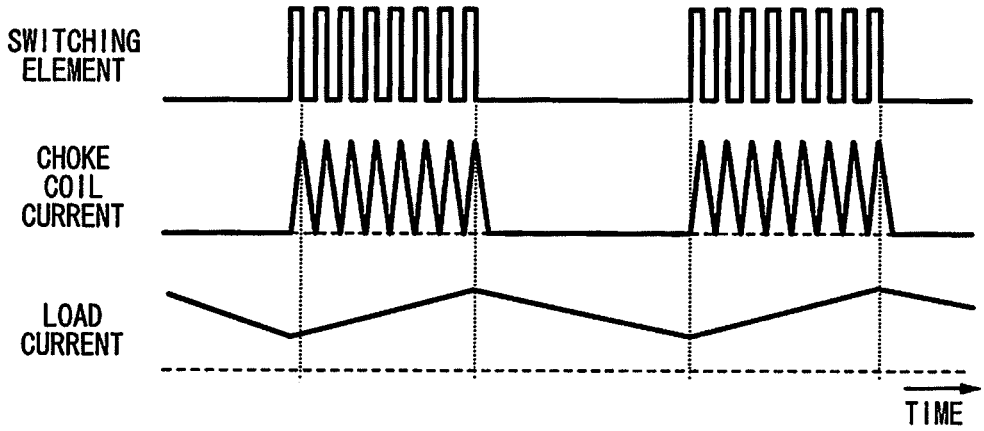
FIG. 2B is a time chart diagram illustrating burst mode control of the electric power conversion unit in the lighting device according to the embodiment of the present invention.
Figure 2C:
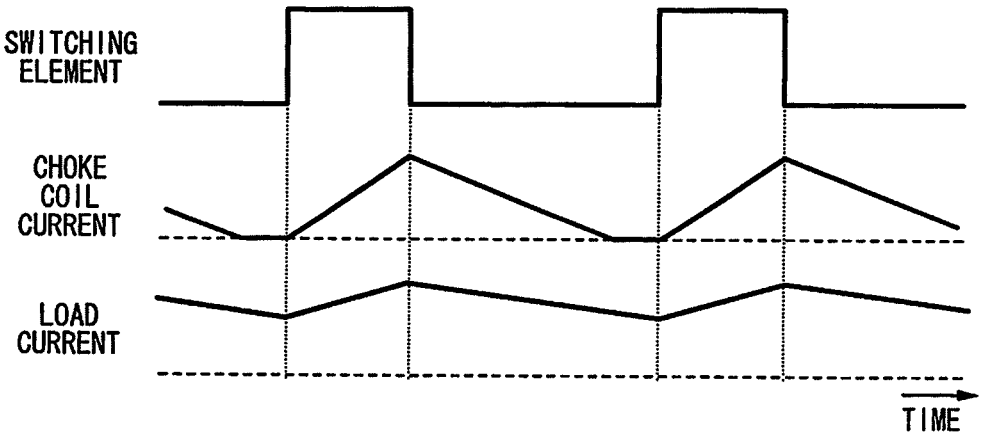
FIG. 2C is a time chart diagram illustrating PWM mode control of the electric power conversion unit in the lighting device according to the embodiment of the present invention.

The control unit 5 may control ON/OFF of the switching element 40 in another mode as long as the load current of the light source load 200 can be controlled constant. For example, as illustrated in FIG. 2B, the control may be performed in a burst mode in which an operation time period during which ON/OFF of the switching element 40 is switched with a high frequency and a termination time period during which an OFF state of the switching element 40 is kept are alternately repeated. When the control is performed in the burst mode, the control unit 5 adjusts the load current that flows through the light source load 200 by changing the width of the operation time period for the drive signal, on the basis of the electric power adjustment value in the signal setting unit 51. In addition, as illustrated in FIG. 2C, the control may be performed in a pulse width modulation (PWM) mode in which an ON time period and an OFF time period of the switching element 40 are alternately repeated. When the control is performed in the PWM mode, the control unit 5 adjusts the load current that flows through the light source load 200 by changing a duty ratio of the drive signal on the basis of the electric power adjustment value in the signal setting unit 51.

The electric power adjustment unit 7 includes the operational amplifier 70 and a capacitor 71 that is connected between an inverting input terminal and output terminal of the operational amplifier 70, and constitutes an integrator. To a non-inverting input terminal of the operational amplifier 70, DC voltage that is output from the control signal input unit 8 that is described later is input. In addition, to the inverting input terminal of the operational amplifier 70, voltage between both ends of the current detection resistor 45 is input through the resistor 72. That is, to the inverting input terminal of the operational amplifier 70, "current detection value" that corresponds to the load current of the light source load 200 is input.

The control signal input unit 8 is connected to a dimming controller (not illustrated) that can be operated from the outside, and outputs DC voltage based on a dimming ratio of a dimming signal that is output from the dimming controller, to the electric power adjustment unit 7 and the electric power calculation unit 9. Hereinafter, a value of the DC voltage that is output from the control signal input unit 8 is referred to as "electric power setting value". The electric power setting value increases as the dimming ratio that is set by the dimming controller increases, and the electric power setting value is reduced as the dimming ratio is reduced. It is noted that a connection means between the control signal input unit 8 and the dimming controller may be any one of a wired means and a wireless means.

An operation of the control unit 5 is described below. When the current detection value that is input to the inverting input terminal of the operational amplifier 70 becomes larger than the electric power setting value that is input to the non-inverting input terminal, the output voltage (electric power adjustment value) of the operational amplifier 70 is reduced. When the electric power adjustment value is reduced, a frequency of the drive signal is set high in the signal setting unit 51. As a result, the load current that flows through the light source load 200 is reduced, and the load electric power is also reduced. On the other hand, when the current detection value that is input to the inverting input terminal of the operational amplifier 70 becomes smaller than the electric power setting value that is input to the non-inverting input terminal, the electric power adjustment value increases. When the electric power adjustment value increases, the frequency of the drive signal is set low in the signal setting unit 51. As a result, the load current that flows through the light source load 200 increases, and the load electric power also increases.

As described above, the control unit 5 controls the load electric power of the light source load 200 to become the constant value based on the electric power setting value by changing a drive frequency of the switching element 40 on the basis of the increase or decrease of the electric power adjustment value that is output from the electric power adjustment unit 7.

The notification unit 10 receives an output signal that includes a calculation result in an input electric power estimation unit 91 of the electric power calculation unit 9, which is described later, and transmits a notification signal that includes the calculation result to an external reading-out apparatus (not illustrated). It is noted that a communication means between the notification unit 10 and the reading-out apparatus may be any one of a wired means and a wireless means. In addition, the notification signal that is transmitted from the notification unit 10 may be any one of a digital signal and an analog signal.

The electric power calculation unit 9 is constituted by the load electric power calculation unit 90 and the input electric power estimation unit 91. The load electric power calculation unit 90 calculates load electric power of the light source load 200 by performing certain calculation on the basis of the output voltage (electric power setting value) of the control signal input unit 8 and the voltage detection value that is detected by the voltage detection unit 6. Specifically, the load electric power is calculated using an equation "$Wk=K\times Ws\times VL$" by representing load electric power as "Wk", an electric power setting value as "Ws", a voltage detection value as "VL", and a correction coefficient as "K".

Here, the load current that flows through the light source load 200 is in proportional to the input voltage (current detection value) of the inverting input terminal of the operational amplifier 70. In addition, the electric power adjustment unit 7 performs feedback control so that the current detection value of the inverting input terminal is equal to the input voltage (electric power setting value) of the non-inverting input terminal. Thus, the load current of the light source load 200 is in proportional to the electric power setting value. In addition, the load voltage of the light source load 200 is in proportional to the voltage detection value because the voltage that is obtained by dividing the load voltage in the voltage detection unit 6 is the voltage detection value. That is, the load electric power calculation unit 90 calculates load electric power on the basis of the load current and the load voltage of the light source load 200. It is noted that the control is performed so that the electric power setting value is equal to the current detection value, and in the above-described equation, the load electric power may be calculated using the current detection value instead of the electric power setting value.

In addition, in the embodiment, the control unit 5 controls the load current of the light source load 200 to become the constant value, so that the voltage detection value varies depending on the ambient temperature. Therefore, the load electric power that is calculated in the load electric power calculation unit 90 is a value in which the variation in the ambient temperature is considered.

The input electric power estimation unit 91 performs calculation so as to estimate the input electric power by using the load electric power that is obtained in the load electric power calculation unit 90 and correcting the load electric power using the constant value as a circuit loss. Specifically, the input electric power is calculated using an equation "$Win=Wk+L$" by representing input electric power as "Win" and representing a loss constant that indicates a circuit loss as "L".

In FIGS. 3A to 3C, results are illustrated that are obtained by changing various conditions to calculate the input electric power and comparing a calculation result with a measured value of the input electric power. In each of FIGS. 3A to 3C, the calculation result and the measured value of the input electric power are compared for each of three patterns of dimming rates of 100%, 60%, and 25%. It is noted that, when the input electric power is calculated, the light source load 200 having rated current 350 mA and rated voltage 93V is used, and the correction coefficient "K" is set at 0.002022, and the loss constant "L" is set at 96.8258.

In FIG. 3A, a table is illustrated in which, for each of three patterns of the power source voltage of the AC power source 100 that corresponds to 100V, 200V, and 242V, the measured value and the calculation result of the input electric power are compared with each other. In FIG. 3B, a table is illustrated in which, for each of two patters of the ambient temperature that corresponds to 0° C. and 50° C., the measured value and the calculation result of the input electric power are compared with each other. Here, when a plurality of light source loads is manufactured, there is variation in characteristics of the light source loads. In FIG. 3C, a table is illustrated in which, for each of two patterns of a light source load 200 (Vfmax) having the maximum rated voltage among the light source loads and a light source load 200 (Vfmin) having the minimum rated voltage among the light source loads, the measured value and the calculation result of the input electric power are compared with each other. In any of FIGS. 3A to 3C, it can be understood that the input electric power can be obtained within a range of error of −3.5% to +3.5% for the measured value.

As described above, in the embodiment, the control unit 5 controls the load current that flows through the light source load 200 to become the constant value, so that the voltage detection value of the load voltage of the light source load 200 varies depending on the ambient temperature. In addition, in the embodiment, the load electric power is calculated on the basis of the voltage detection value that is in proportional to the load voltage of the light source load 200 and the electric power setting value that is in proportional to the load current of the light source load 200. That is, in the embodiment, the load electric power and the input electric power can be obtained while both of variation in the ambient temperature of the light source load 200 and variation in the characteristics of the light source loads 200 are considered. Thus, in the embodiment, even when there is variation in the characteristics of the light source loads 200 and variation in the ambient temperature of the light source load 200, the input electric power can be obtained sufficiently accurately.

It is noted that, in the calculation in the input electric power estimation unit 91, the loss constant "L" may be changed on the basis of the lighting state of the light source load 200. Specifically, the input electric power is calculated using an equation "Win=Wk+M×Ws" by representing a loss coefficient as "M". In this case, the circuit loss is corrected while the change in the lighting state of the light source load 200 is considered, so that the input electric power can be calculated further accurately.

Figure 4:
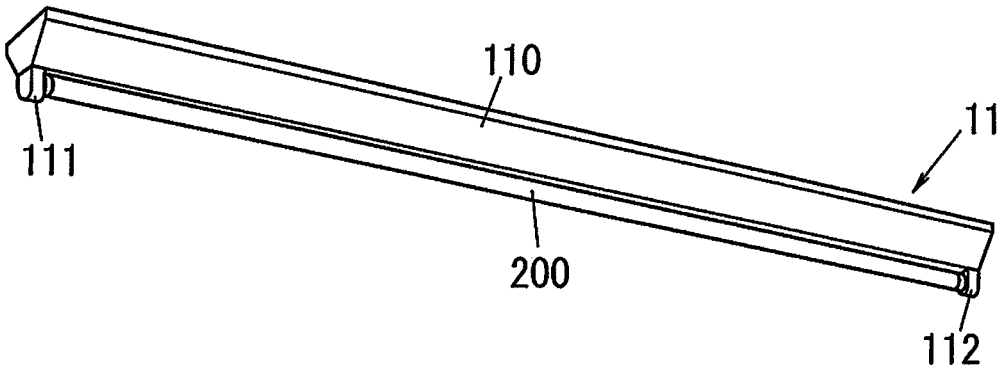
FIG. 4 is a perspective view illustrating a lighting apparatus according to the embodiment of the present invention.

As illustrated in FIG. 4, the lighting device 1 according to the above-described embodiment is built, for example, in a ceiling-mounted type fixture body 110, and constitutes a lighting apparatus 11 with the light source load 200 (here, a straight tube light emitting diode (LED) lamp) that is held by the fixture body 110. The lighting apparatus 11 corresponds to one of the embodiments of the present invention. It is noted that the lighting device 1 and the light source load 200 are electrically connected to each other through a pair of sockets 111 and 112 that are provided in the fixture body 110.

A lighting system that includes the plurality of the lighting apparatuses 11 corresponds to one of the embodiment of the present invention. In the lighting system, a system administrator and the user receive a notification signal that is output from each of the notification units 10 of the plurality of the lighting apparatuses 11 by using a remote control receiver, a personal computer, etc. that can display a numeric value as a reading-out apparatus. Thus, the system administrator and the user can grasp a used electric power amount with an inexpensive configuration by receiving the notification signal from each of the notification units 10 and reading the calculation result of the input electric power estimation unit 91 by the single reading-out apparatus.

The present invention is described above with reference to the some preferable embodiments, and various modifications and variations are possible by those skilled in the art without departing from the spirit and scope of the present invention, that is, the scope of the claims.

The invention claimed is:

1. A lighting device comprising:

an electric power conversion unit comprising a switching element, configured to adjust load electric power that is supplied to a light source load using DC electric power as an input by ON/OFF of said switching element;

a current detection unit configured to detect load current that flows through said light source load;

a voltage detection unit configured to detect load voltage that is applied to said light source load;

a control unit configured to control an operation of said electric power conversion unit so that said load current that flows through said light source load becomes a constant value, using an electric power setting value that is used to determine a size of electric power that is supplied to said light source load and a current detection value that is detected by said current detection unit;

a load electric power calculation unit configured to obtain load electric power of said light source load using said electric power setting value and a voltage detection value that is detected by said voltage detection unit;

an input electric power estimation unit configured to correct a circuit loss for the obtained load electric power and estimate input electric power; and a notification unit configured to notify an outside of a calculation result that is obtained in said input electric power estimation unit.

2. The lighting device as set forth in claim 1, wherein said input electric power estimation unit estimates said input electric power using the corrected circuit loss as a constant value regardless of input voltage and a lighting state of said light source load.

3. The lighting device as set forth in claim 1, wherein said input electric power estimation unit changes the circuit loss that is corrected using said electric power setting value, based on a lighting state of said light source load and estimates said input electric power.

4. The lighting device as set forth in claim 1, wherein said notification unit transmits a notification signal that comprises said calculation result of said input electric power estimation unit as a digital signal.

5. The lighting device as set forth in claim 1, wherein said notification unit transmits a notification signal that comprises said calculation result of said input electric power estimation unit as an analog signal.

6. A lighting apparatus comprising:

the lighting device as set forth in claim 1; and a fixture body configured to hold the lighting device and said light source load.

7. A lighting system comprising:

a plurality of lighting apparatuses, each of which is said lighting apparatus as set forth in claim 6; and a reading-out apparatus configured to receive a notification signal that is transmitted from said notification unit of said lighting apparatus and read out said calculation result of said input electric power estimation unit.

* * * * *